US007671301B2

(12) United States Patent
Elkasevic

(10) Patent No.: US 7,671,301 B2
(45) Date of Patent: Mar. 2, 2010

(54) COOKING APPLIANCE COWLING APPARATUS AND METHOD

(75) Inventor: Suad Elkasevic, Winterville, NC (US)

(73) Assignee: BSH Home Appliances Corporation, Huntington Beach, CA (US)

( * ) Notice: Subject to any disclaimer, the term of this patent is extended or adjusted under 35 U.S.C. 154(b) by 34 days.

(21) Appl. No.: 11/592,923

(22) Filed: Nov. 2, 2006

(65) Prior Publication Data

US 2008/0105250 A1 May 8, 2008

(51) Int. Cl.

| | |
|---|---|
| ***A21B 1/14*** | (2006.01) |
| ***A21B 1/22*** | (2006.01) |
| ***F27D 1/00*** | (2006.01) |
| ***F27D 11/02*** | (2006.01) |

(52) U.S. Cl. ..... 219/407; 219/391; 219/405

(58) Field of Classification Search ..... 219/407
See application file for complete search history.

(56) References Cited

U.S. PATENT DOCUMENTS

| | | | | |
|---|---|---|---|---|
| 1,225,827 | A * | 5/1917 | Kuhn et al. | 219/520 |
| 1,620,602 | A * | 3/1927 | Mayer | 219/395 |
| 2,035,757 | A * | 3/1936 | Ottenstein | 219/407 |
| 2,498,583 | A * | 2/1950 | Schulze | 219/403 |
| 3,731,039 | A * | 5/1973 | Beech | 219/407 |
| 4,880,952 | A * | 11/1989 | Hirai et al. | 219/685 |
| 6,008,478 | A * | 12/1999 | Crone et al. | 219/402 |
| 6,121,584 | A * | 9/2000 | Key et al. | 219/407 |
| 6,359,262 | B1 * | 3/2002 | Robertson et al. | 219/407 |

* cited by examiner

*Primary Examiner*—Joseph M Pelham
(74) *Attorney, Agent, or Firm*—James E. Howard; Andre Pallapies

(57) ABSTRACT

A cooking appliance heating element shield apparatus and method are provided. The apparatus is adapted for use in an electric self-cleaning cooking appliance of the type having an oven cavity heated by a coil heating element of a heating element assembly. The apparatus includes an elongate main portion comprising a substantially planar surface and adapted for positioning between the oven cavity and a portion of the heating element to dissipate direct heat transmitted to the oven cavity from the heating element. The apparatus also includes at least one connection portion adapted for removably attaching the elongate main portion to the heating element assembly.

16 Claims, 8 Drawing Sheets

COOKING APPLIANCE COWLING APPARATUS AND METHOD

BACKGROUND OF THE INVENTION

The invention disclosed herein relates generally to cooking appliances, and more particularly to a cowling operable in an electric self-cleaning cooking appliance and a method for influencing a property of the air via which convection heating of an oven cavity of an electric self-cleaning cooking appliance is effected.

Substances baked or broiled inside an oven may generate materials, such as, for example, grease, which over time may become undesirably deposited as cooking food residues or deposits on the walls defining the heated space of an oven, stove, or range (hereinafter "ovens" for simplicity) and/or any apparatuses deployed within the heated space such as, for example, a broiling tray. One type of oven, such as is disclosed in U.S. Pat. No. 4,357,522, is a so-called self-cleaning or pyrolytic oven that has, in addition to the capability to cook and heat food, the capability to burn or vaporize the cooking residues or deposits left in the oven cavity. When operated to burn or vaporize the cooking residues or deposits left in the oven cavity, these self-cleaning or pyrolytic ovens such disclosed in U.S. Pat. No. 4,357,522 achieve temperatures higher than typical food preparation temperatures, often in the range of 750-930 degrees Fahrenheit (400-500 degrees Celsius), for the express purpose of burning or vaporizing the cooking residues left in the oven cavity. These higher temperatures in the range of 750-930 degrees Fahrenheit (400-500 degrees Celsius) are typically generated by one or more of the heating elements that normally serve to heat the oven cavity for food preparation purposes, such as, for example, a broiling element located internally to—i.e., within—the oven cavity or a bake heating element located externally to the oven cavity.

One type of commercially available self-cleaning or pyrolytic oven has an oven cavity whose interior surface, which delimits or defines the heated space, is comprised of a relatively smooth enamel material. It can happen during a self cleaning operation in such a commercially available self-cleaning or pyrolytic oven that the achieved higher temperatures in the range of 750-930 degrees Fahrenheit (400-500 degrees Celsius) result in an alteration in the appearance of the relatively smooth enamel material forming the interior surface of the oven cavity. This alteration is observed visually in the sense that the relatively smooth enamel material forming the interior surface of the oven cavity appears to have, after a number of self-cleaning operations have been performed, a very slightly different appearance as compared to its appearance before the self-cleaning operations were performed. To be sure, an alteration in the appearance of the relatively smooth enamel material forming the interior surface of an oven cavity of an oven does not invariably mean that the oven has been compromised in any way, as it is clear that the desired properties provided by such relatively smooth enamel material interior oven cavity surfaces, such as heat distribution and resistance to deposition of food residues thereon, are still provided by such relatively smooth enamel material interior oven cavity surfaces even though an alteration in the appearance of such can be visually observed. Nonetheless, in the interest of providing a greater capability to preserve or influence the appearance of relatively smooth enamel material interior oven cavity surfaces of ovens, it would be desirable to have an arrangement and a method for influencing the heat generated by a heating element located exteriorly to the wall of the oven cavity of an oven to thereby preserve or influence the appearance of an interior oven cavity surface of such an oven in a positive manner.

Moreover, it can be understood that a self-cleaning or pyrolytic oven may be subject to operational disadvantages if, due to the particular configuration of self-cleaning or pyrolytic oven, a heating element thereof torques, warps, or otherwise temporarily changes its shape during the self-cleaning process to an extent that a portion of the heating element touches or more closely approaches a portion of the structure that forms the oven cavity. For example, in one known configuration of a self-cleaning or pyrolytic oven, the structure that forms the oven cavity has a concave bottom shape in a center location and an exteriorly located heating element may be located within 1-2 millimeters of this concave bottom shaped structure in an unheated condition of the oven.

Also, it can be further understood that a user's acceptance of, or confidence in, the performance of a self-cleaning or pyrolytic oven may be negatively affected if there occurs an alteration in the appearance of the relatively smooth enamel material interior oven cavity surface to such a degree that there is discoloration, scorching, or even cracking of the surface.

As such, there remains a need to provide, with respect to self-cleaning ovens, an arrangement and a method for influencing the heat generated by a heating element located exteriorly to the wall of the oven cavity of such an oven to thereby preserve or influence the appearance of an interior oven cavity surface of such an oven in a positive manner.

BRIEF SUMMARY OF THE INVENTION

According to one aspect of the one embodiment of the present invention, a cowling operable in an electric self-cleaning cooking appliance is provided, wherein the electric self-cleaning cooking appliance has a means forming an oven cavity and a resistance coil disposed exteriorly of, and at a spacing from, the oven cavity and operable to effect convection heating of the oven cavity via heating of air adjacent to and in contact with the resistance coil and the means forming an oven cavity. The cowling includes a body portion that is positionable intermediate, and at respective spacings from, both the means forming an oven cavity and at least a portion of the resistance coil, the body portion for influencing a property of the air via which convection heating of the oven cavity is effected.

According to another aspect of the one embodiment of the present invention, a heating element shield apparatus is provided. The apparatus is adapted for use in an electric self-cleaning cooking appliance of the type having an oven cavity heated by a coil heating element of a heating element assembly. The apparatus comprises an elongate main portion comprising a substantially planar surface and adapted for positioning between the oven cavity and a portion of the heating element to dissipate direct heat transmitted to the oven cavity from the heating element. The apparatus also comprises at least one connection portion adapted for removably attaching the elongate main portion to the heating element assembly.

An electric self-cleaning cooking appliance is also provided. The cooking appliance comprises a frame and an oven cavity defined by top, bottom, and side walls attached to the frame and which can be heated for a self-cleaning operation. The cooking appliance also comprises at least one heating element assembly removably attached to the frame and being located outside of the oven cavity wherein a space is defined between the heating element assembly and at least one of the chamber walls, wherein the heating element assembly comprises a coil heating element adapted to provide heat to the oven cavity and at least one tie rod. The cooking appliance further comprises a heating element shield removably attached to a portion of the heating element assembly and adapted to be located substantially in the space between the heating element assembly and the at least one cavity wall, wherein the heating element shield comprises an elongate main portion comprising a substantially planar surface and at least one connection portion for removably attaching the elongate main portion to the heating element assembly.

A method is also provided for assembling an electric self-cleaning cooking appliance. The method generally comprises the steps of providing a frame; providing an oven cavity defined by top, bottom, and side walls and which can be heated for a self-cleaning operation; providing at least one heating element assembly comprising a coil heating element adapted to provide heat to the oven cavity and at least one tie rod; and providing a heating element shield comprising an elongate main portion comprising a substantially planar surface and at least one connection portion having at least one connector arm. The method also comprises the step of removably attaching the at least one heating element assembly to the frame outside of the oven cavity, wherein a space is defined between the heating element assembly and at least one of the cavity walls. The method further comprises the step of removably attaching the heating element shield to a portion of the heating element assembly, wherein the shield is located in the space between the heating element assembly and the at least one cavity wall.

It is therefore an object to provide a cooking appliance heating element shield apparatus and method in order to alleviate the negative attributes associated with high-heat self-cleaning cycles of prior art cooking appliances.

An object of the present invention having been stated hereinabove, and which is addressed in whole or in part by the present invention, other objects will become evident as the description proceeds when taken in connection with the accompanying drawings as best described hereinbelow.

DETAILED DESCRIPTION OF THE INVENTION

Figure 1:
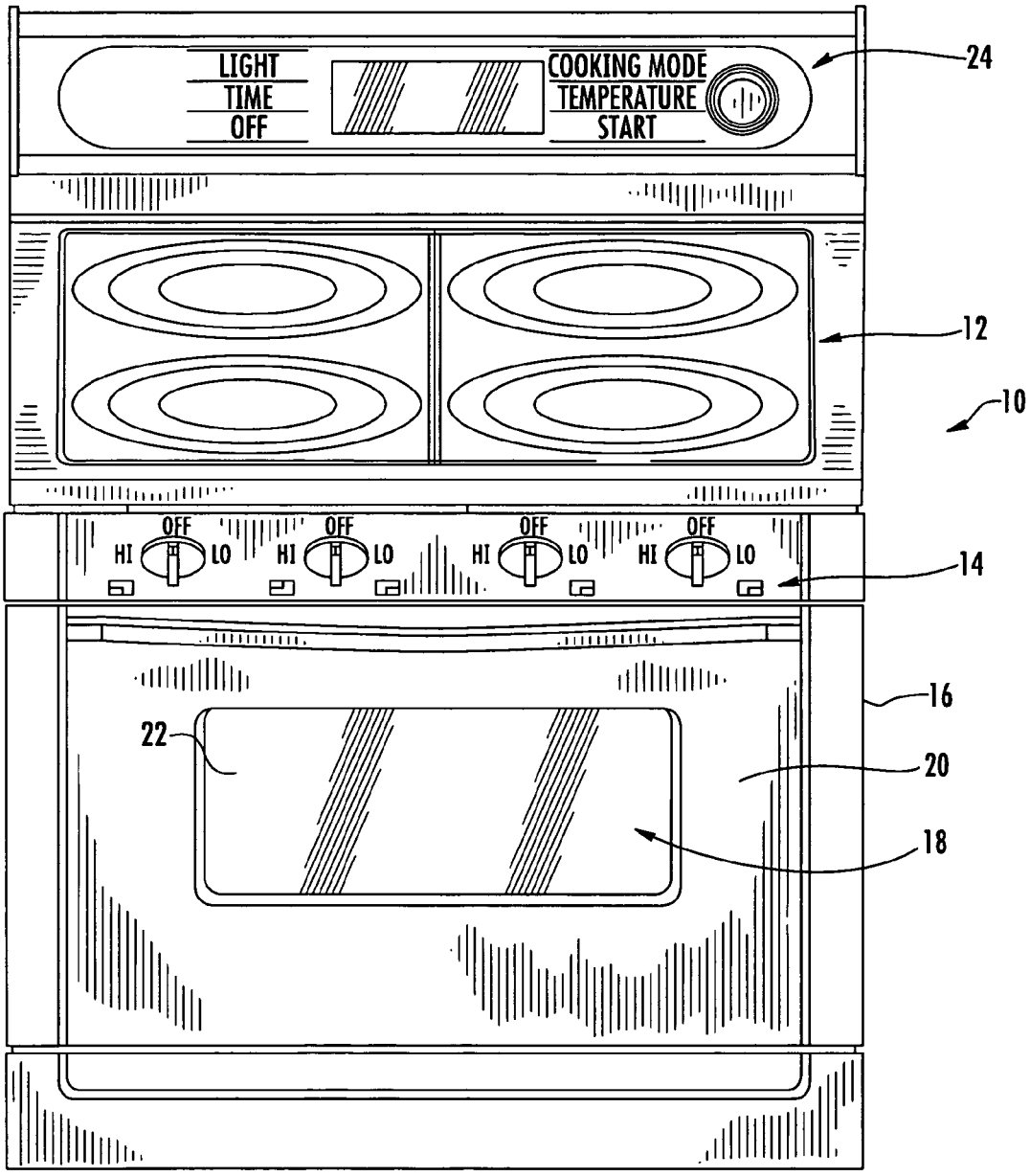
FIG. 1 is a perspective view of a self-cleaning oven in which the heating element shield of the present invention can be utilized.
Figure 2:
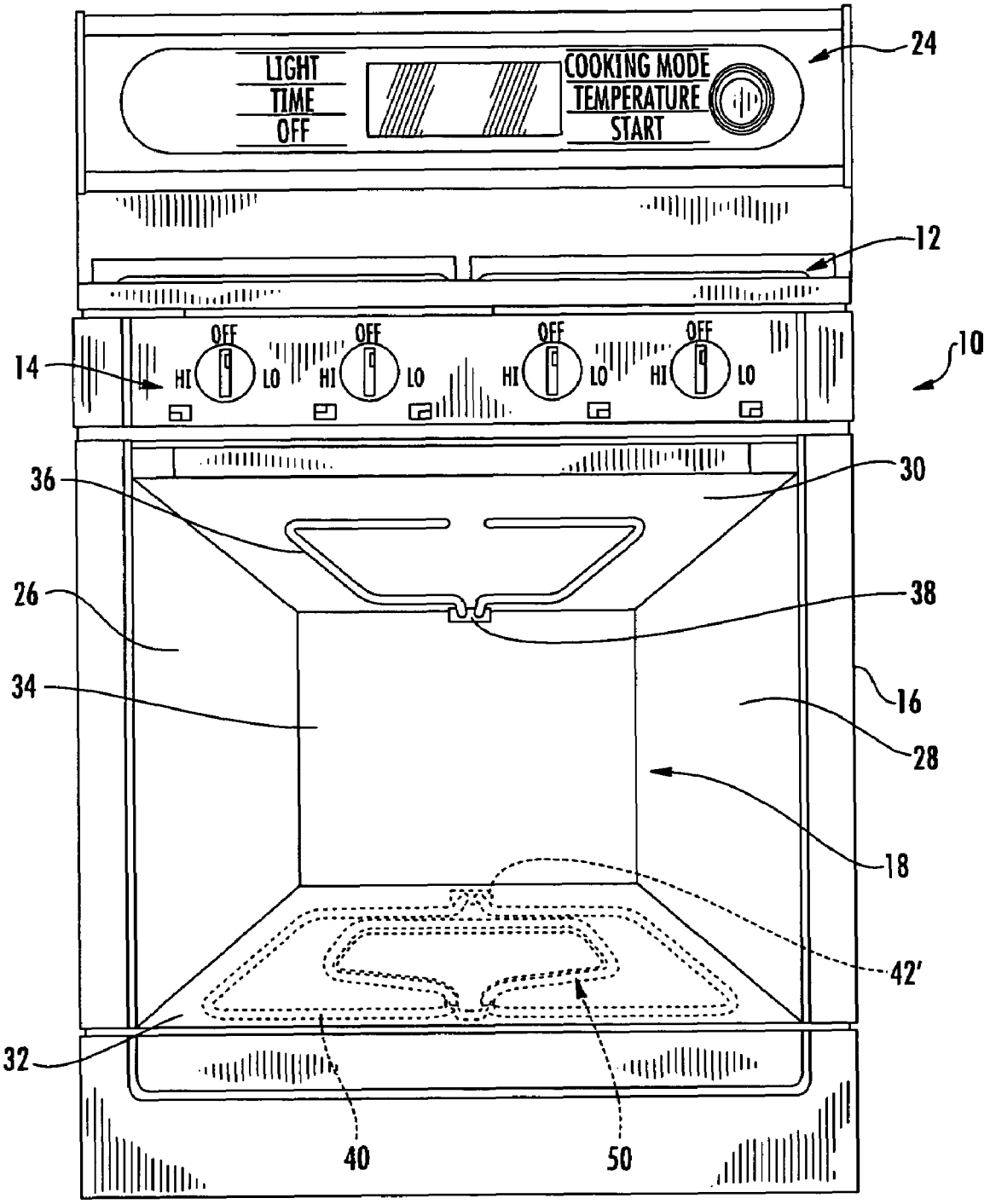
FIG. 2 is a front plan view of the oven of FIG. 1 including a schematic view of one location of the heating element shield of the present invention.

Referring now to FIGS. 1 and 2, the apparatus of the present invention can be installed in an electric oven or range 10 ("oven" is used for ease of reference hereinafter), such as a free standing range as illustrated or a built in oven (not illustrated). The oven 10 can include a range top 12 and an associated control panel 14 for the burners of the range top 12. The oven 10 includes a frame 16, with an oven cavity 18 in the lower portion thereof below the range top 12 as is conventional when such a range top 12 is included with the oven 10. The oven cavity 18 is closed by an oven door 20, which generally can include a window 22 for the user to view the inside of the oven cavity 18, such as to view food cooking in the oven cavity 18. The operation of the oven cavity 18 is controlled by the user utilizing a second control panel 24. The self-cleaning operation of the oven cavity 18 is controlled by operation of the control panel 24.

With reference to FIG. 2, the oven cavity 18 generally has side walls 26 and 28, a top wall 30, a bottom wall 32, and a back wall 34. In the immediate vicinity of the top wall 30, an interior or broil heating element (resistance coil) 36 can be disposed for grilling or broiling. The broil heating element 36 can be of any heating element known in the art and is in contact with a plug 38, for example, or another type of connecting element through its electrical terminals. Below the bottom wall 32 of the oven cavity 18, an external or bake heating element 40 is disposed and is in contact with another plug 42, for example, or another type of connecting element through its electrical terminals.

Figure 3:
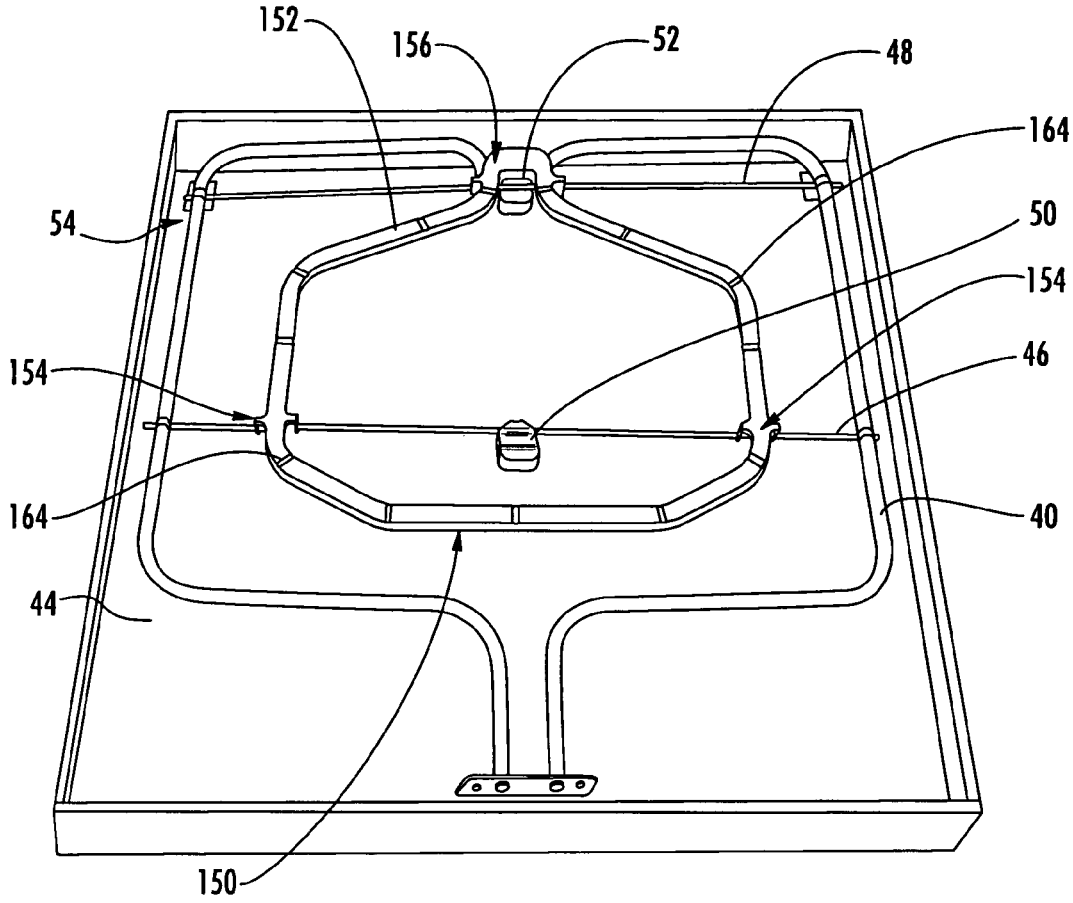
FIG. 3 is a perspective view of a heating element assembly installed in an element pan and showing the cowling of the present invention in the form of a heating element shield.

As is particularly shown in FIG. 3, the bake heating element 40 can sit inside an element pan or tray 44 and can be supported by tie rods 46, 48, which themselves are fastened to the element pan 44 such as at connection points or mounting flanges 50, 52. It is understood that the bake heating element 40 individually or the bake heating element 40 in conjunction with the tie rods 46, 48 can comprise a heating element assembly 54. When the element pan 44, along with the heating element assembly 54, is installed below the bottom wall 32 of the oven cavity 18, a space (not shown) is generally defined between the bake heating element 40 and chamber bottom wall 32. During predetermined conditions, a portion of this space along the length of the bake heating element 40 between the bake heating element 40 and chamber bottom wall 32 becomes more narrow or altogether ceases to exist when the bake heating element 40 torques or warps during the self-cleaning cycle to an extent that the bake heating element 40 touches or contacts the bottom wall 32 of the oven 10.

As seen in FIGS. 3-8, there is provided, in accordance with the present invention, one embodiment of a cowling 100 operable in an electric self-cleaning cooking appliance such as the oven 10 for influencing the heat generated by a heating element located exteriorly to the wall of the oven cavity of the oven 10 to thereby preserve or influence the appearance of an interior oven cavity surface of the oven 10 in a positive manner. The electric self-cleaning cooking appliance has a means forming an oven cavity and a resistance coil disposed exteriorly of, and at a spacing from, the oven cavity and operable to effect convection heating of the oven cavity via heating of air adjacent to and in contact with the resistance coil and the means forming an oven cavity. The cowling 100 includes a body portion that is positionable intermediate, and at respective spacings from both, the means forming an oven cavity and at least a portion of the resistance coil and the body portion influences a property of the air via which convection heating of the oven cavity is effected.

Further details of the one embodiment of the cowling 100 will now be described with reference to FIGS. 3-8, wherein the cowling 100 is in the form of a heating element shield 150 operable to both influence the heat generated by the bake heating element 40 located exteriorly to the wall of the oven cavity 18 to thereby preserve or influence the appearance of an interior oven cavity surface of the oven 10 in a positive manner and to mitigate or foreclose any undesirable effects that would otherwise occur if a portion of the bake heating element 40 were to torque, warp, or otherwise temporarily change its shape during a self-cleaning process to an extent such that a portion of the heating element 38 touches or more closely approaches a portion of the chamber-bottom wall 32.

With reference now to FIGS. 3-8, the shield 150 of the present invention is designed to be removably attached to the heating element assembly 54. While the shield 150 of the present invention is shown and described herein as being attached to the heating element assembly 54 including the bake heating element 40 and tie rods 46, 48, it is contemplated that the shield 150 could be used with any heating element whose close proximity to a wall of oven cavity 18 creates negative attributes as described hereinabove if the heating element touches the wall.

Figure 7:
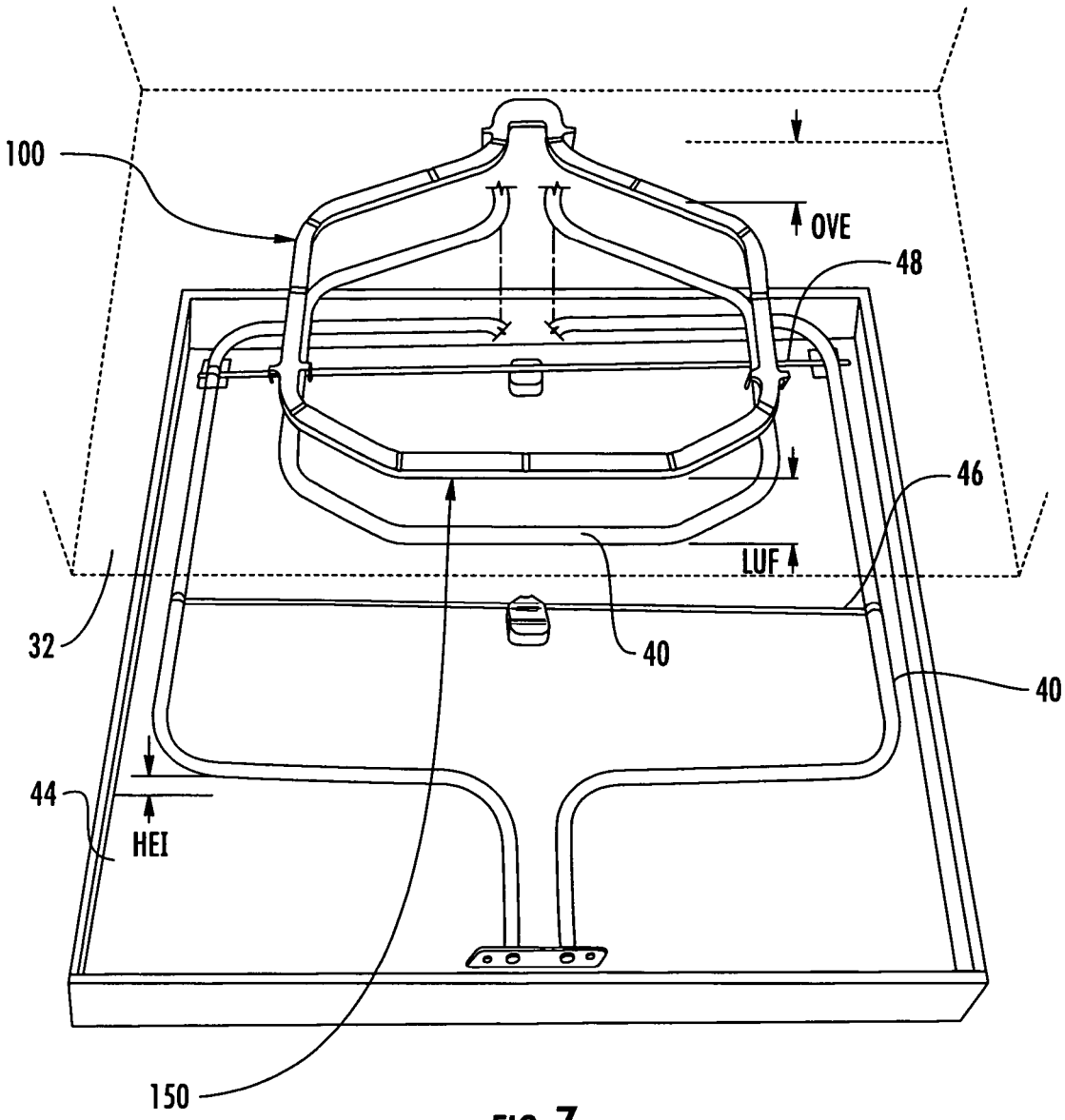
FIG. 7 is an exploded perspective view of the heating element assembly installed in an element pan and the one embodiment of the cowling during a period when the oven is not being operated in a self-cleaning mode.

Referring to FIGS. 3 and 7, the shield 150 comprises an elongate main portion 152 generally corresponding to the overall shape or footprint of the portion of the bake heating element 40 that is closest to the chamber bottom wall 32. The chamber bottom wall 32 as described hereinabove is typically concave-shaped in the middle and, as such, the center portion of bake heating element 40 is the portion most apt to touch the chamber bottom wall 32 during the self-cleaning cycle. As such, the elongate main portion 152 of the shield 150 as illustrated generally corresponds in the shape to the center portion of the bake heating element 40. The length of the elongate main portion 152 of the shield 150 can vary depending on the shape of the bake heating element 40 desired to be covered, such as, for example, a length of 95 centimeters as shown in FIG. 3. The elongate main portion 152 is preferably in a "closed loop" configuration as shown for ease of fabrication.

The width of the elongate main portion 152, as measured perpendicularly to the elongate extent of the elongate main portion 152, is at least as wide as the bake heating element 40 and is preferably wider than the bake heating element 40 in that the elongate main portion 152 extends laterally perpendicularly to the elongate extent of the elongate main portion 152 to both lateral sides of the bake heating element 40, whereupon the width of the elongate main portion 152 is preferably one hundred and fifty percent (150%) to three hundred percent (300%) of width of the bake heating element 40. As such, the preferable width of the elongate main portion 152 is in the range of 15 millimeters for a typical bake heating element 40 as shown and which has a width of 15 millimeters. Thickness of the elongate main portion 152 can depend on the type of construction material used, but preferably is around 0.95 millimeters.

As seen in FIG. 7, the resistance coil in the form of the bake heating element 40 has a length extent lying in a longitudinal plane. In the exemplary electric self cleaning oven 10, the bottom wall 32, while of a concave shape, delimits or defines an oven bottom wall plane that is horizontal and the bake heating element 40 has an length extent lying in a longitudinal plane that is parallel to this oven bottom wall horizontal plane of the bottom wall 32 of the oven 10. The body portion of the cowling 100 includes a substantially planar surface extending generally parallel to the longitudinal plane and this substantially planar surface is elongate in a length direction of the body portion. The substantially planar surface of the body portion of the cowling 100 has a width extent as measured parallel to the longitudinal plane and transversely to the length extent of the body portion and this width extent of the substantially planar surface of the body portion is preferably in a range of 10-50 millimeters and the thickness is in the range of 0.7-1.0 millimeters.

The shield 150 is preferably made of a material that will withstand the high temperatures produced by the bake heating element 40 without cracking or breaking. Metals, ceramics, and even some high temperature plastics are contemplated as suitable materials. Preferably, the shield 150 is made of a heat conducting material that easily reflects and/or dissipates the generated heat to the surrounding air. Metals are the preferred material for construction of the shield 150, with steel being the preferred metal. A coating to protect the metal from corrosion at high temperatures is preferably used. Most commonly, steel is coated with another metal that is more reactive in the electromotive series, so that, in the presence of an electrolyte, such as humid air, the coating metal rather than the steel is affected. Zinc (galvanizing) or aluminum coating of the steel are the most preferred coatings, but any coating may be used that will reduce rapid corrosion that is possible from high temperature oxidation.

Figure 4:
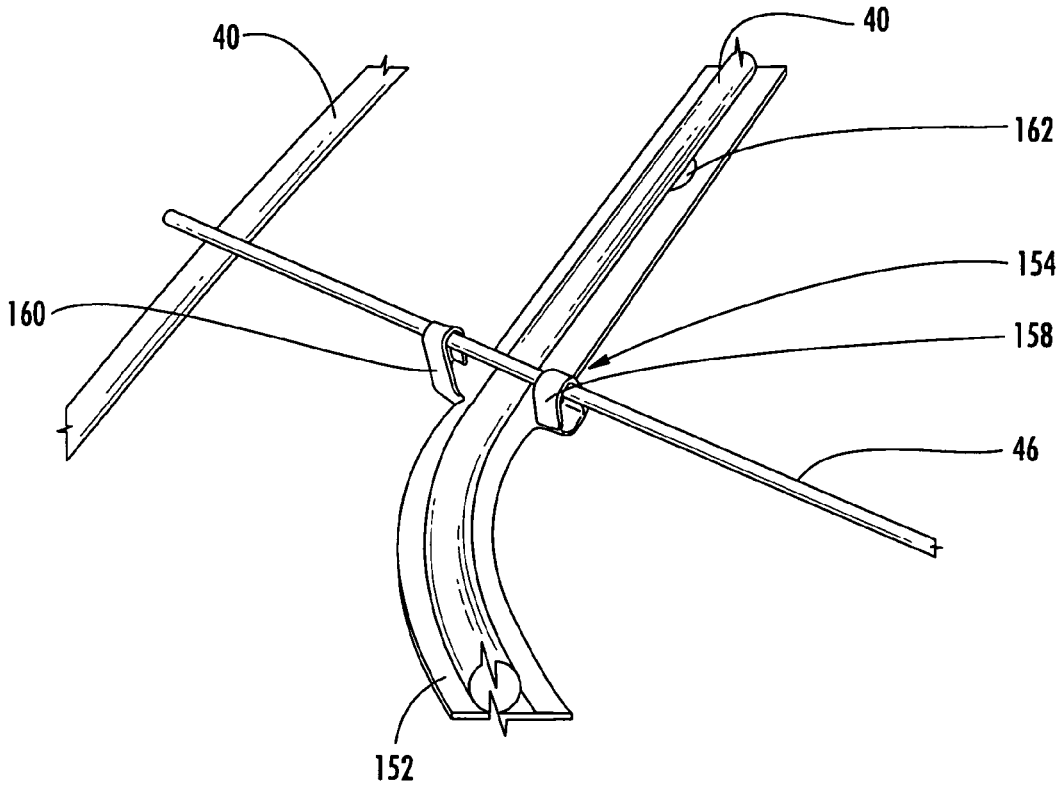
FIG. 4 is a perspective bottom detailed view of the heating element shield of the present invention connecting to a heating element assembly.
Figure 5:
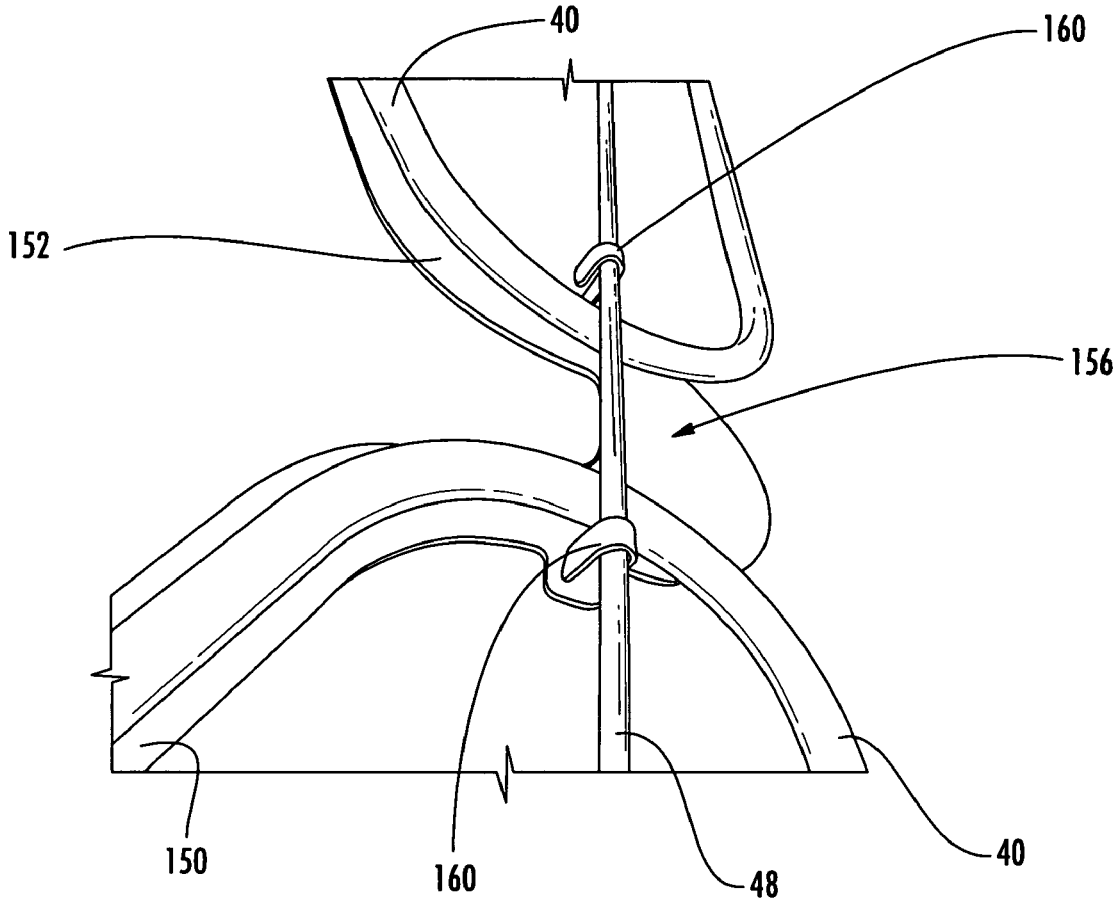
FIG. 5 is a perspective bottom detailed view of the heating element shield of the present invention connecting to a heating element assembly.

With further reference to FIGS. 3-5, the shield 150 is removably attached to the heating element assembly 54 by the connection portions 154, 156. A preferable material in which the elongate main portion 152 and connection portions 154, 156 are constructed as a unitary member is 20 gauge aluminized metal.

As seen in particular in FIG. 4, the connection portions 154, 156 can include connector arms 158, 160 wherein the connector arms 158, 160 are attached around the tie rods 46, 48, respectively, thereby securing the shield 150 to the heating element assembly 54. Preferably, the connection portions 154, 156 (with the connector arms 158, 160) and the elongate main portion 152 comprise a unitary member and are preferably fabricated, as by stamping, from a single piece of metal. It is additionally contemplated that the shield 150 can be mounted adjacent to the heating element assembly 54 such as by connections to the element pan 44 and the like.

Figure 6:
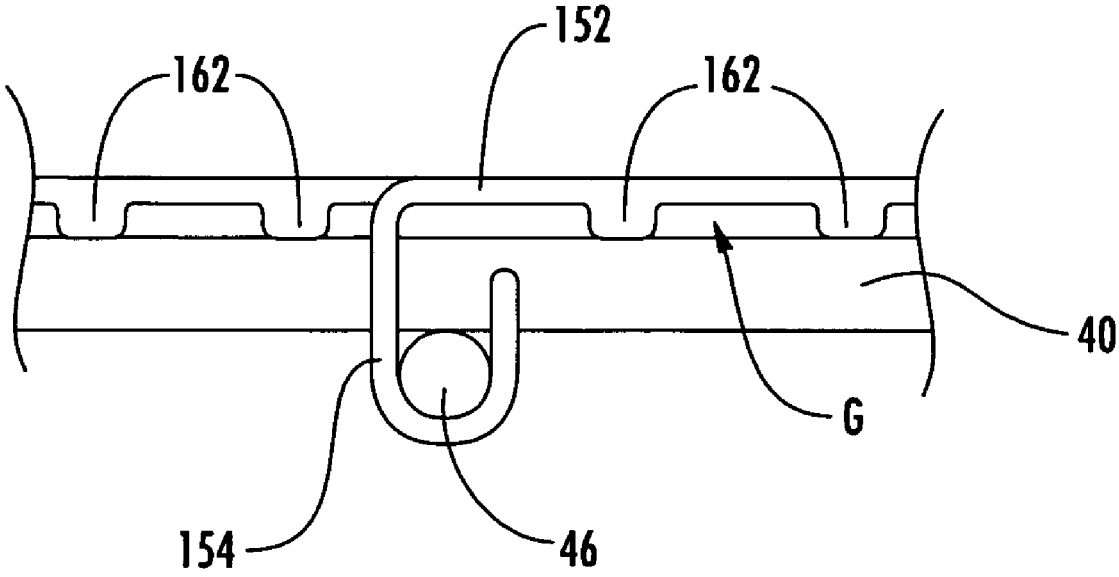
FIG. 6 is a side plan detailed view of the heating element shield of the present invention attached to a heating element assembly.

Referring to FIGS. 3, 4 and 6, the elongate main portion 152 of the shield 150 can further include a series of protrusions 162, 164 that downwardly project from the surface of the elongate main portion 152 towards the bake heating element 40 and which will provide the only contacts of the elongate main portion 152 with the bake heating element 40. The protrusions 162, 164 can be spaced at various intervals along the length of the elongate main portion 152 in order to act as spacers wherein a gap G is defined between the elongate main portion 152 of the shield 150 and the bake heating element 40.

While the interval spacing between the protrusions 162, 164 along the length of the elongate main portion 152 will vary depending on the length of the elongate main portion 152, a spacing of 6 centimeters is preferable as shown. Additionally, the depth length of the protrusions 162, 164 extending from the surface of the elongate main portion 152 is preferably in the range of 1.2-1.5 millimeters, thereby producing a gap G of equivalent size, as seen in FIG. 6. The protrusions 162,164 are preferably formed within the elongate main portion 152 itself, such as by stamping, as a dimple 162 (see FIGS. 4 and 6) or a channel 164 (see FIG. 3) or other similar shape. It is additionally envisioned that the protrusions 162 can be formed from a separate protruding body, such as a metal spacer, that is attached to the surface of the elongate main portion 152 and projects toward the bake heating element 40 for the desired gap G distance.

It is contemplated that the shield 150 of the present invention can be installed during initial assembly of the oven 10 or installed in existing units. As described above, the shield 150 can be removably attached to the heating element assembly 54 such as by attachment of the connector arms 158, 160 of the connection portions 154, 156 to the tie rods 46, 48. The installation of the shield 150 on the heating element assembly 54 provides an arrangement that influences air flowing around and in contact with the portion of the heating element 38 closest to the bottom wall 32 of the oven 10 to be favorably influenced such that at least some of the negative attributes attributable to the execution of self-cleaning cycles in cooking appliances are alleviated.

Thus, it can be seen that the one embodiment of the cowling 100, in the form of the shield 150, is operable in an electric self-cleaning cooking appliance such as the oven 10 for influencing the heat generated by a heating element located exteriorly to the wall of the oven cavity of the oven 10 to thereby preserve or influence the appearance of an interior oven cavity surface of the oven 10 in a positive manner. The cowling 100 is, as exemplarily described with respect to the shield 150, operable in an electric self-cleaning cooking appliance such as the oven 10, that has a means forming an oven cavity, such as the oven cavity 18, and a resistance coil, such as the bake heating element 40, disposed exteriorly of, and at a spacing from, the oven cavity and operable to effect convection heating of the oven cavity via heating of air adjacent to and in contact with the resistance coil and the means forming an oven cavity. Additionally, it can be seen that the cowling 100 of the present invention comprises a body portion, such as the elongate main portion 152 of the shield 150, having at least one substantially planar surface for positioning between, and at respective spacings from both, the means forming an oven cavity and at least a portion of the resistance coil, wherein the body portion influences a property of the air via which convection heating of the oven cavity is effected.

A description of the operation of the cowling 100 in its installed position in an electric self-cleaning cooking appliance such as the oven 10 will follows hereinafter with reference to FIG. 7, which is an exploded perspective view of the heating element assembly installed in an element pan and the one embodiment of the cowling 100 during a period when the oven 10 is not being operated in a self-cleaning mode, and FIG. 8, which is art exploded perspective view of the heating element assembly installed in an element pan and the one embodiment of the cowling 100 during a period when the oven 10 is being operated in a self-cleaning mode. As seen in FIG. 7, during a period when the oven 10 is not being operated in a self-cleaning mode, the bake heating element 40 and a nominal horizontal plane extending through the tray 44 are at a vertical spacing HEI from one another, as measured perpendicularly to the plane of the bottom wall 32 of the oven 10. Additionally, the bake heating element 40 and the elongate main portion 152 of the shield 150 are at a vertical spacing LUF from one another, as measured perpendicularly to the plane of the bottom wall 32 of the oven 10. Furthermore, the elongate main portion 152 of the shield 150 and the lowermost (the exterior) surface of the bottom wall 32 of the oven 10 are at a vertical spacing OVE from one. another, as measured perpendicularly to the plane of the bottom wall 32 of the oven 10. While the oven 10 is not being operated in a self-cleaning mode in the illustration thereof shown in FIG. 7, the oven 10 can be operated during this time to perform typical food warming and heating functions, wherein the oven 10 may, for example, be operated to provide an oven cavity temperature of between 250 degrees F. and 475 degrees F. During such typical food warming and heating functions, the bake heating element 40 is correspondingly energized to provide electric resistance heat, whereupon air in contact with the bake heating element 40 and the bottom wall 32 of the oven 10 is heated and this heated air provides convection heating to the oven 10 via the bottom wall 32 of the oven 10. Also, the cowling 100 during such typical food warming and heating functions influences this air to the extent that flows of this air impact the cowling 100 or are aerodynamically influenced by the presence of the cowling 100.

Figure 8:
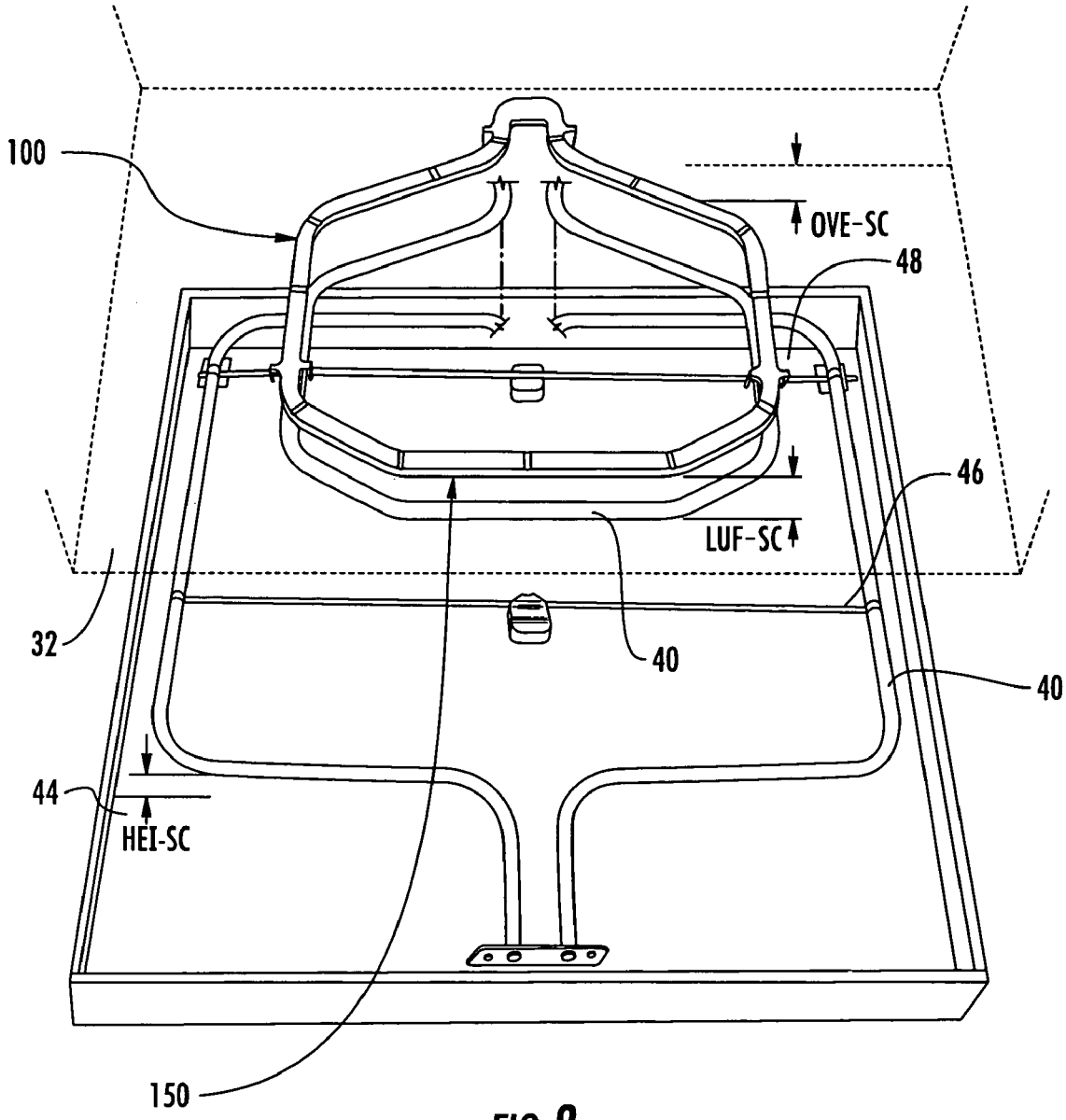
FIG. 8 is an exploded perspective view of the heating element assembly installed in an element pan and the one embodiment of the cowling during a period when the oven is operated in a self-cleaning mode.

As seen in FIG. 8, during a period when the oven 10 is being operated in a self-cleaning mode to provide an oven temperature of between 750 degrees F. and 930 degrees F., the bake heating element 40 and a nominal horizontal plane extending through the tray 44 are at the vertical spacing HEI-SC from one another. This vertical spacing HEI-SC may differ from the vertical spacing HEI of the bake heating element 40 and a nominal horizontal plane extending through the tray 44 during the period of operation of the oven 10 illustrated in FIG. 7, depending upon the influence of the increased temperatures experienced by the bake heating element 40 during a self-cleaning operation. For example, the bake heating element 40 may warp slightly downwardly along some portions thereof, whereupon the vertical spacing HEI-SC of the bake heating element 40 and a nominal horizontal plane extending through the tray 44 at such a location may be less than the vertical spacing HEI of the bake heating element 40 and a nominal horizontal plane extending through the tray 44 during the period of operation of the oven 10 illustrated in FIG. 7. Additionally, during a period when the oven 10 is being operated in a self-cleaning mode, the bake heating element 40 and the elongate main portion 152 of the shield 150 are at a vertical spacing LUF-SC from one another, as measured perpendicularly to the plane of the bottom wall 32 of the oven 10. This vertical spacing LUF-SC may differ from the vertical spacing LUF of the bake heating element 40 and the elongate main portion 152 of the shield 150 from one another during the period of operation of the oven 10 illustrated in FIG. 7, depending upon the influence of the increased temperatures experienced by the bake heating element 40 during a self-cleaning operation. For example, the bake heating element 40 may warp slightly upwardly along some portions thereof and the cowling 100 may warp slightly downwardly along some portions thereof, whereupon the vertical spacing LUF-SC of the bake heating element 40 and the elongate main portion 152 of the shield 150 from one another at such a location may be less than, or more than, the vertical spacing LUF of the bake heating element 40 and the elongate main portion 152 of the shield 150 from one another during the period of operation of the oven 10 illustrated in FIG. 7. Furthermore, the elongate main portion 152 of the shield 150 and the lowermost (the exterior) surface of the bottom wall 32 of the oven 10 are at a vertical spacing OVE-SC from one another, as measured perpendicularly to the plane of the bottom wall 32 of the oven 10. This vertical spacing OVE-SC may differ from the vertical spacing OVE of the elongate main portion 152 of the shield 150 and the lowermost (the exterior) surface of the bottom wall 32 of the oven 10 from one another during the period of operation of the oven 10 illustrated in FIG. 7, depending upon the influence of the increased temperatures experienced by the bake heating element 40 during a self-cleaning operation. For example, the lowermost (the exterior) surface of the bottom wall 32 of the oven 10 may warp slightly downwardly along some portions thereof and the cowling 100 may warp slightly upwardly along some portions thereof, whereupon the vertical spacing OVE-SC of the lowermost (the exterior) surface of the bottom wall 32 of the oven 10 and the elongate main portion 152 of the shield 150 from one another at such a location may be less than, or more than, the vertical spacing OVE of the bake heating element 40 and the elongate main portion 152 of the shield 150 from one another during the period of operation of the oven 10 illustrated in FIG. 7.

During a self cleaning operation of the oven 10, the bake heating element 40 is correspondingly energized to provide electric resistance heat, whereupon air in contact with the bake heating element 40 and the bottom wall 32 of the oven 10 is heated and this heated air provides convection heating to the oven 10 via the bottom wall 32 of the oven 10. The cowling 100 during a self cleaning operation of the oven 10 influences this air to the extent that flows of this air impact the cowling 100 or are aerodynamically influenced by the presence of the cowling 100 to thereby preserve or influence the appearance of an interior oven cavity surface of the oven 10 in a positive manner. For example, the cowling 100 may influence the air to provide a different distribution of peak temperatures than if the cowling 100 were not provided. It can be understood that, in an arrangement wherein the cowling 100 is not provided, heated air contacting the bottom wall 32 of the oven 10 may impart heat to the oven 10 as required for a successful self cleaning operation yet the heat imparted may unduly stress a given portion of the oven 10, thereby leading to, at the least, an alteration in the appearance of a ceramic lining of the oven 10. On the other hand, in an arrangement wherein the cowling 100 is provided, this air having a different distribution of peak temperatures may still sufficiently impart heat to the oven 10 as required for a successful self cleaning operation yet the heat imparted would not unduly stress any given portion of the oven 10.

The cowling 100 can be accommodated into ovens that have already been installed in a respective commercial or residential user environment as well as accommodated into ovens during the manufacturing thereof. Thus, the present invention provides a method accommodating a cowling into an electric self-cleaning cooking appliance. The method generally comprises the steps of providing an electric self-cleaning cooking appliance having a frame, an oven cavity defined by top, bottom, and side walls and which can be heated for a self-cleaning operation, at least one heating element assembly comprising a coil heating element adapted to provide heat to the oven cavity, and at least one tie rod. The method further includes providing a heating element shield comprising an elongate main portion comprising a substantially planar surface and at least one connection portion having at least one connector arm. The method also comprises the step of removably attaching the at least one heating element assembly to the frame outside of the oven cavity, wherein a space is defined between the heating element assembly and at least one of the cavity walls. The method further comprises the step of removably attaching the heating element shield to a portion of the heating element assembly, wherein the shield is located in the space between the heating element assembly and the at least one cavity wall.

It will be understood that various details of the present invention may be changed without departing from the scope of the present invention. Furthermore, the foregoing description is for the purpose of illustration only, and not for the purpose of limitation, as the present invention is defined by the claims as set forth hereinafter.

What is claimed is:

1. A cowling operable in an electric self-cleaning cooking appliance, the electric self-cleaning cooking appliance having a means forming an oven cavity and a resistance coil disposed exteriorly of, and at a spacing from, the oven cavity and operable to effect convection heating of the oven cavity via heating of air adjacent to and in contact with the resistance coil and the means forming an oven cavity, the cowling comprising:

a body portion that is positionable intermediate, and at respective spacings from both, the means forming an oven cavity and at least a portion of the resistance coil, the body portion for influencing a property of the air via which convection heating of the oven cavity is effected wherein the resistance coil includes a curved segment and a straight segment, and wherein the body portion includes a corresponding curved segment and a corresponding straight segment that substantially trace the curved segment and the straight segment of the resistance coil.

2. The cowling according to claim 1 wherein the resistance coil has an length extent lying in a longitudinal plane and the body portion includes a substantially planar surface extending generally parallel to the longitudinal plane and elongate in a length direction of the body portion.

3. A cowling operable in an electric self-cleaning cooking appliance, the electric self-cleaning cooking appliance having a means forming an oven cavity and a resistance coil disposed exteriorly of, and at a spacing from, the oven cavity and operable to effect convection heating of the oven cavity via heating of air adjacent to and in contact with the resistance coil and the means forming an oven cavity, the cowling comprising:

a body portion that is positionable intermediate, and at respective spacings from both, the means forming an oven cavity and at least a portion of the resistance coil, the body portion for influencing a property of the air via which convection heating of the oven cavity is effected wherein the resistance coil has an length extent lying in a longitudinal plane and the body portion includes a substantially planar surface extending generally parallel to the longitudinal plane and elongate in a length direction of the body portion, and the substantially planar surface of the body portion has a width extent as measured parallel to the longitudinal plane and transversely to the length extent of the body portion, the thickness extent of the substantially planar surface of the body portion being in a range of about 0.95 millimeters to about 1.25 millimeters, and wherein the resistance coil has a curved segment and a straight segment, and the body portion has a corresponding curved segment and a corresponding straight segment that substantially trace the curved segment and the straight segment of the resistance coil.

4. The cowling according to claim 1 wherein the body portion comprises a material selected from the group consisting of aluminized metal, galvanized metal, ceramic, and high temperature plastic.

5. The cowling according to claim 4 wherein the body portion comprises 20 gauge aluminized metal.

6. The cowling according to claim 1 wherein the electric self-cleaning cooking appliance includes a resistance coil support assembly supporting the resistance coil at a spacing from the means forming an oven cavity and further comprising at least one connection portion for removably attaching the body portion to the resistance coil support assembly.

7. The cowling according to claim 6 wherein the body portion and the at least one connection portion form a unitary member.

8. The cowling according to claim 1 and further comprising at least one protrusion extending from the surface of the body portion in a direction toward the resistance coil in the installed position of the cowling, the at least one protrusion being operable to contact the resistance coil in the event of predetermined movement of at least one of the resistance coil and the body portion toward one another.

9. The cowling according to claim 8 wherein the at least one protrusion is configured as a dimple or channel defined in the body portion.

10. The cowling according to claim 1 wherein the at least one protrusion is configured as a separate protruding body attached to the surface of the body portion.

11. The cowling according to claim 1 wherein the protrusion extends from the surface of the elongate main portion in a depth length range of about 1.2 millimeters—about 1.5 millimeters.

12. The cowling according to claim 1 wherein the electric self-cleaning cooking appliance includes a resistance coil support assembly supporting the resistance coil at a spacing from the means forming an oven cavity and the resistance coil support assembly includes at least one tie rod and further comprising at least one connection portion for removably attaching the body portion to the at least one tie rod of the resistance coil support assembly.

13. An electric self-cleaning cooking appliance comprising:

a. a frame;

b. an oven cavity defined by top, bottom, and side walls attached to the frame and which can be heated for a self-cleaning operation;

c. at least one heating element assembly removably attached to the frame and being located outside of the oven cavity wherein a space is defined between the heating element assembly and at least one of the cavity walls, wherein the heating element assembly comprises:

i. a coil heating element adapted to provide heat to the oven cavity; and ii. at least one tie rod; and d. a heating element shield removably attached to a portion of the heating element assembly and adapted to be located substantially in the space between the heating element assembly and the at least one cavity wall, wherein the heating element shield comprises:

i. an elongate main portion comprising a substantially planar surface; and ii. at least one connection portion for removably attaching the elongate main portion to the heating element assembly, wherein the width of the shield elongate main portion is about 15 millimeters and the thickness is about 0.95 millimeters.

14. The cooking appliance of claim 13 wherein the shield elongate main portion and at least one connection portion comprise a unitary member.

15. The cooking appliance of claim 13 wherein the shield elongate main portion comprises a material selected from the group consisting of aluminized metal, galvanized metal, ceramic, and high temperature plastic.

16. The cooking appliance of claim according to claim 13 wherein the shield elongate main portion comprises 20 gauge aluminized metal.

* * * * *